United States Patent [19]

Mishima

[11] 4,408,512

[45] Oct. 11, 1983

[54] TONE SOURCE OF RHYTHM

[75] Inventor: Toshio Mishima, Kitamoto, Japan

[73] Assignees: Kabushiki Kaisha Kawai Gakki Seisakusho; Tokyo Shibaura Denki Kabushiki Kaisha, both of Japan

[21] Appl. No.: 292,910

[22] Filed: Aug. 14, 1981

[30] Foreign Application Priority Data

Aug. 30, 1980 [JP] Japan ..... 55-119928

[51] Int. Cl.[3] ..... G10H 1/42

[52] U.S. Cl. ..... 84/1.03; 84/DIG. 12

[58] Field of Search ..... 84/1.03, DIG. 12

[56] References Cited

U.S. PATENT DOCUMENTS

Re. 26,521 2/1969 Park ..... 84/1.03

3,590,131 6/1971 Reyers ..... 84/1.03

FOREIGN PATENT DOCUMENTS 55-41464 3/1980 Japan .

56-117289 9/1981 Japan .

*Primary Examiner*—Stanley J. Witkowski

*Attorney, Agent, or Firm*—McGlew and Tuttle

[57] ABSTRACT

A rhythm tone source which is provided with a noise generator composed of a plurality of shift registers which generate random pulses in synchronism with clock pulses supplied thereto, respectively, means for selecting the clock pulses to be applied to the shift registers, and means for controlling the input and output connections between the shift registers. The both means are changed over in combination with each other.

5 Claims, 6 Drawing Figures

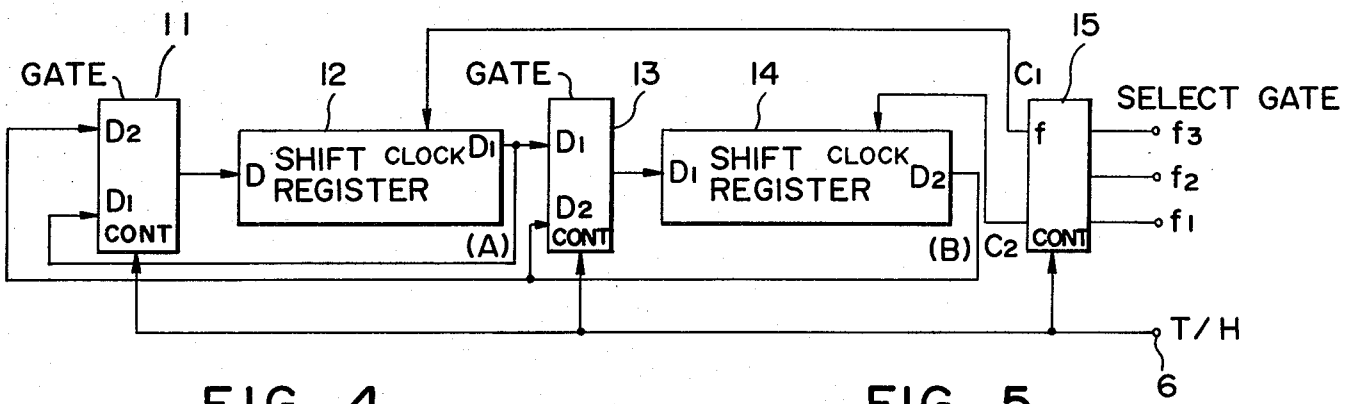
FIG. 3
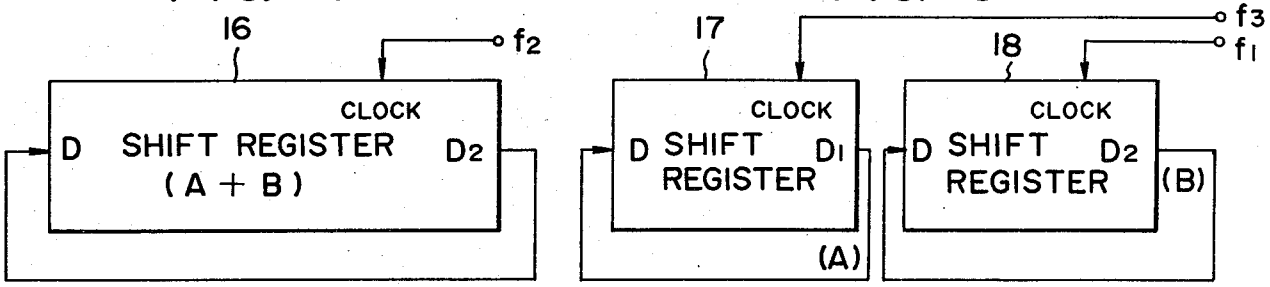
FIG. 5
FIG. 4

TONE SOURCE OF RHYTHM

FIELD AND BACKGROUND OF THE INVENTION

The present invention relates to a tone source of rhythm which is designed to permit an arbitrary selection of a noise component and a pitch determining component as a tone source of cymbals or the like.

Heretofore, there have been proposed, for obtaining a tone source of cymbals or the like, a method of mixing pluralities of transistor noises and notes, a method using digital noises and so forth, but many of them are of the type employing either noise or pitch determining components only.

It has also been proposed to employ a noise generator composed of an N-stage shift register such as set forth in Japanese Pat. Appln. No. 115,393/78 "Noise Generator" now Laid-Open Publication 55-41464. As depicted in FIG. 1, outputs from first and Nth stages of an N-stage shift register 1, which is driven by clock pulses, are provided to an exclusive OR circuit 2, which yields an output "1" or "0" depending on whether the inputs are of the same or different levels. The output from the exclusive OR circuit 2 is fed back to the first stage of the shift register 1 via an OR circuit 3, thus obtaining $2^N-1$ pseudo-random pulses from the Nth stage output in one period. If $N=8$, then $2^8-1=255$. If the clock pulses have a frequency of 100 KHz, then the repetitive frequency f of noise is as follows:

$$f=\frac{100\times 10^3}{255}=329.16\text{ Hz},$$

producing a noise having a frequency of 392.16 Hz.

FIG. 2 shows the noise thus obtained. The pulse train is a noise when it is produced for only one period, but it includes pitch determining components when repeated at a frequency of 392.16 Hz. These components vary with the number of stages of the shift register and the clock frequency. A decrease in the number of stages of the shift register decreases the noise component but increases the pitch determining component, whereas an increase in the number of stages of the shift register increases the former and decreases the latter.

Natural sounds of musical instruments such as cymbals and the like are more complex in the contents of the noise component and the pitch determining component, their mixing ratio and their repetitive frequencies. To obtain wide varieties of the contents and repetitive frequencies of these components, there has been proposed that outputs from a pluraity of noise generators which respectively yields random pulses in synchronism with different clock pulses and have different repetitive frequencies are provided via a nonlinear gate, for example, an AND gate, as set forth in Japanese Pat. Appln. No. 21380/80 "Rhythm Tone Source" now Laid-Open Publication 56-117289. This permits arbitrary and various selections of the noise and pitch determining components but the arrangement is fixed, and hence it has the problem that long-time playing may become monotonous.

SUMMARY OF THE INVENTION

It is an object of the present invention to provide a simple-structured tone source of rhythm which is adapted for easy variations of noise and pitch determining components during playing.

To achieve the above objective, the rhythm tone source of the present invention is provided with a noise generator composed of a plurality of shift registers which respectively generate random pulses in synchronism with clock pulses supplied thereto, means for selecting the clock pulses for each shift register and means for controlling the input/output connection between adjacent ones of the shift registers, the both means being changed over in combination.

BRIEF DESCRIPTION OF THE DRAWINGS

FIG. 3 is a block diagram illustrating an embodiment of the present invention;

FIGS. 4 and 5 are schematic diagrams explanatory of its operation; and

DESCRIPTION OF THE PREFERRED EMBODIMENTS

An embodiment of the present invention will hereinafter be described in detail.

Figure 1:
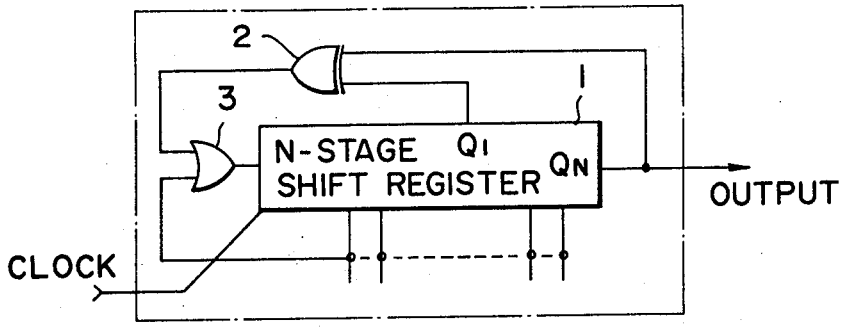
FIGS. 1 and 2 are explanatory of the outline of a conventional noise generator.
Figure 2:
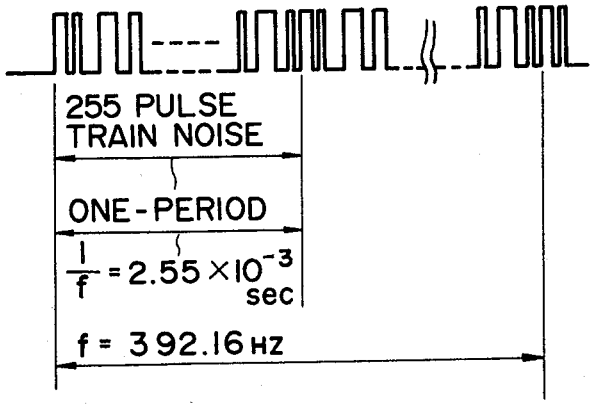

In FIG. 3 a noise generator comprises shift registers (A)12 and (B)14, which are supplied with different clock pulses $C_1$ and $C_2$ via a frequency select gate 15 to generate random pulses as is the case with FIG. 1. Gates 11 and 13 are provided for connecting the outputs of the shift registers 12 and 14 to their inputs, respectively. Upon application of a control signal from a T/H (Total/Half) control terminal 6, the gates 11 and 13 perform the abovesaid connection, along with the frequency select gate 15 for selecting the clock pulses $C_1$ and $C_2$ from frequencies $f_1$ to $f_3$.

When the control signal at the T/H control terminal 6 is "T", the gates 11 and 13 select $D_2$ and $D_1$, respectively, and the frequency select gate 15 selects $C_2=f_2$, constituting a noise generator (A+B)16 shown in FIG. 4. That is, the shift registers (A)12 and (B)14 are combined into the shift register (A+B)16. As a result of this, the number of stages of the shift register increases to provide for increased noise component and decreased pitch determining component.

When the control signal is "H", the gates 11 and 13 select $D_1$ and $D_2$, respectively, and the frequency select gate 15 selects $C_1=f_3$ and $C_2=f_1$, by which are obtained independent noise generators formed by shift registers (A)17 and (B)18, respectively, as shown FIG. 5. In this case, since the number of stages of each noise generator decreases, the noise component decreases but the pitch determining component increases. When these components are simultaneously produced, they are superimposed on each other at different repetitive frequencies, with an arbitrary phase difference therebetween, creating a musical effect different from that obtainable in the case of FIG. 4. It is also possible, of course, to activate the noise generators 17 and 18 separately of each other.

Figure 6:
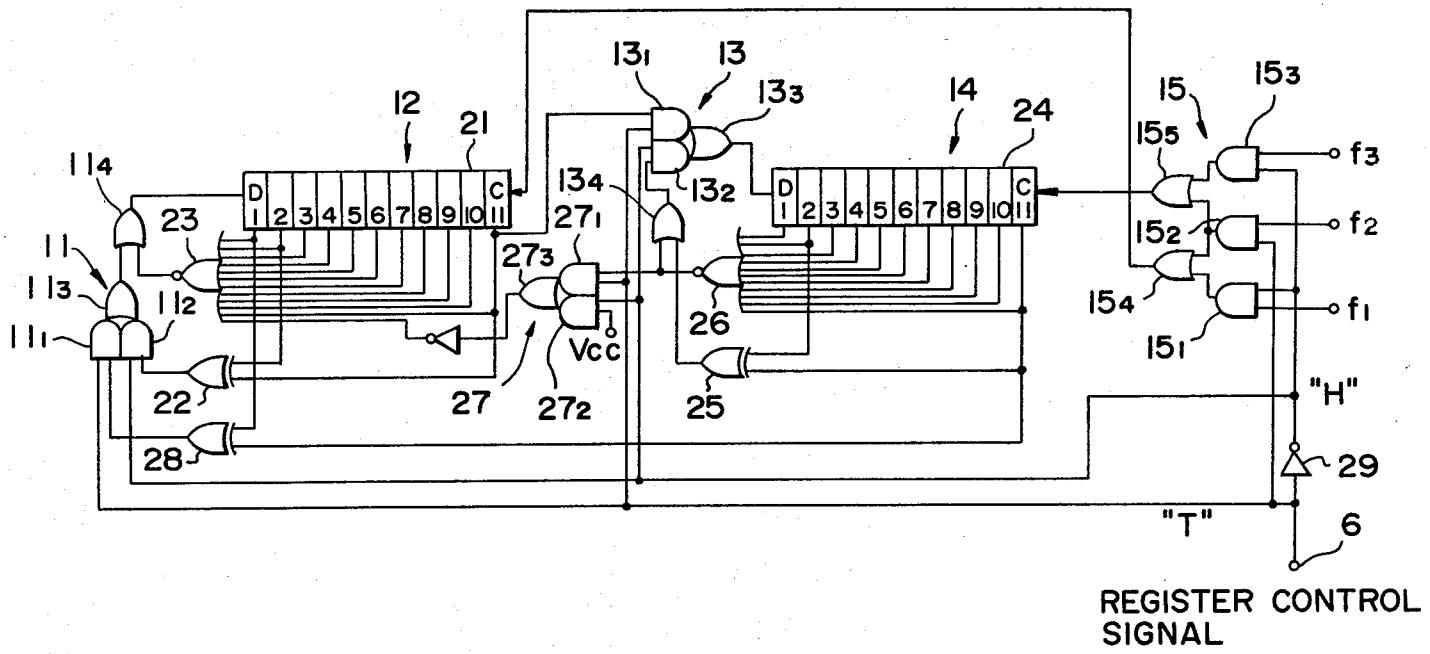
FIG. 6 is a circuit diagram showing a specific arrangement of the embodiment depicted in FIG. 3.

FIG. 6 illustrates in detail a specific arrangement of the embodiment of FIG. 3. In FIG. 6 the shift registers 21 and 24 corresponding to those 12 and 14, respectively, are identical in construction and shifted by clock pulses from the frequency gate 15. Outputs from second and last stages of the shift registers 21 and 24 are respectively provided to their first stages via exclusive OR circuits 22 and 25 and then via the gates 11 and 13 controlled by the control signal from the T/H control terminal 16, thus producing noise components. In order that even if outputs from respective stages of the registers 21 and 24 are all "0", inputs may be applied to their first stages, the stage outputs are applied to the gates 11 and 13 via NOR circuits 23 and 26, respectively. Further, the output from the NOR circuit 26 is provided to a gate 27 for interconnecting both the registers to obtain an inverted output, which is fed to the input of the N,OR circuit 23. In the case where both the registers 21 and 24 are combined into one shift register, the output from the first stage of the shift register 21 and the output from the last stage of the shfit register 24 are provided via an exclusive OR circuit 28 to the gate 11, generating noise components by the combined shift registers.

In the frequency select gate 15, AND gates $15_1$ to $15_3$ are supplied with clock pulses $f_1$ of three frequencies to $f_3$, respectively. For example, when the control signal "T" from the T/H control terminal 6 is "1", the clock pulses of the frequency $f_2$ alone are provided to the shift registers 21 and 24 via the AND gate $15_2$ and OR circuits $15_4$ and $15_5$, respectively.

On the other hand, the output from the gate 11 is applied to the first stage of the shift register 21 via an AND circuit $11_1$ and OR circuits $11_3$ and $11_4$ in synchronism with the output from the exclusive OR circuit 28 alone. In this case, the output from the exclusive OR circuit 22 is inhibited by an AND circuit $11_2$. The output from the gate 13 is provided to the first stage of the shift register 24 via an AND circuit $13_1$ and an OR circuit $13_3$ in synchronism with the output from the last stage of the shift register 21 and, at the same time, it is applied to the NOR circuit 23 via an AND circuit $27_1$ and an OR circuit $27_3$ after being inverted, in synchronism with the output from the NOR circuit 26. In this case, the output from the exclusive OR circuit 25 is inhibited by an OR circuit $13_4$. Accordingly, the shift registers 21 and 24 are combined into one to produce noise components by the exclusive OR circuit 28, thus obtaining a noise generator of a unitary structure which is shifted by the clock pulses $f_2$ depicted in FIG. 3.

Next, when the control signal "H" from the T/H control terminal 6 is "1", the clock pulses of the frequencies $f_1$ and $f_3$ are applied to the shift registers 21 and 24 via the OR circuits $15_4$ and $15_5$. In this case, the gate 11 is synchronized with only the output from the exclusive OR circuit 22 to permit its passage through the AND circuit $11_2$ but inhibit the passage of the output from the exclusive OR circuit 28 through the AND circuit $11_1$. The gate 13 applies the output from the exclusive OR circuit 25 to the first stage of the shift register 24 via the OR circuit $13_4$, an AND circuit $13_2$ and an OR circuit $13_3$. The output from the last stage of the shift register 21 is inhibited by the AND circuit $13_1$. In the gate 27 the output from the NOR circuit 26 is inhibited by the AND circuit $27_1$ only by applying a predetermined signal $V_{CC}$ to an AND circuit $27_2$ and, consequently, the shift registers 21 and 24 are completely disconnected from each other and operate as two independent noise generators, which are shifted by the clock pulses $f_1$ and $f_2$, as depicted in FIG. 3.

Although in the above embodiment two shift registers are selectively combined into one noise generator or disconnected from each other into two independent noise generators through the use of clock pulses of three frequencies, it is also possible to divide a plurality of shift registers into a desired number of combinations of them using a plurality of clock pulses.

As has been described in the foregoing, the rhythm tone source of the present invention comprises a noise generator composed of a plurality of shift registers, means for selecting clock pulses to be supplied to the shift registers and means for controlling the input and output connections of the shift registers, and the selection and the control are changed over in combination with each other. With such an arrangement, the noise and pitch determining components can arbitrarily be selected as a tone source of cymbals or the like and, in addition, they can be changed over at one time, so that their combination can easily be modified during playing.

It will be apparent that many modifications and variations may be effected without departing from the scope of the novel concepts of this invention.

What is claimed is:

1. A rhythm tone source comprising:

a plurality of shift registers, each register having a plurality of stages, a first input to one stage for a clock pulse, a second input to one stage for a feedback pulse and at least one output from one stage, each register being shifted from one stage to another by one of the clock and feedback pulses, said plurality of shift registers forming a noise generator for generating random pulses on said at least one output of at least one of said plurality of shift registers;

first means for providing one of a plurality of clock pulses to said first input of each of said shift registers; and second means for selectively connecting said second input of each of said shift registers to said at least one output of any one of said shift registers;

wherein each shift register is shiftable by both said first and said second means.

2. A rhythm tone source according to claim 1, wherein each stage of each of said plurality of shift registers has an output, an exclusive OR gate having inputs connected to all outputs of each shift register respectively, an output of each exclusive OR gate connected to an input of said second means.

3. A rhythm tone source according to claim 2, wherein said second means comprises a control gate connected to the second input of each shift register, each control gate having an input connected to an output of each exclusive OR gate respectively.

4. A rhythm tone source according to claim 3, wherein said first means comprises a selector gate having a plurality of inputs for receiving a plurality of clock pulses and an output connected to said first input of each shift register.

5. A rhythm tone source according to claim 4, including a control terminal connected to each control and selector gate for controlling the operation of each control and selector gate.

* * * * *